United States Patent [19]

Prysby

[11] Patent Number: 4,803,465

[45] Date of Patent: Feb. 7, 1989

[54] APPARATUS FOR IMPROVING THE RELIABILITY OF AN ALARM CIRCUIT

[75] Inventor: Daniel G. Prysby, Elk Grove Village, Ill.

[73] Assignee: Honeywell Inc., Minneapolis, Minn.

[21] Appl. No.: 880,626

[22] Filed: Jul. 1, 1986

[51] Int. Cl.[4] ..... G08B 29/00

[52] U.S. Cl. ..... 340/507; 340/506; 340/508

[58] Field of Search ..... 340/507, 506, 505, 508, 340/509–511, 514, 517, 518

[56] References Cited

U.S. PATENT DOCUMENTS

| | | | |
|---|---|---|---|
| 3,212,078 | 8/1962 | Shanahan | 340/513 |
| 3,448,447 | 6/1969 | Tetherow | 340/513 |
| 3,569,964 | 3/1971 | Mande | 340/513 |
| 3,618,081 | 11/1971 | Morrow | 340/513 |
| 3,711,854 | 1/1973 | Reynolds et al. | 340/513 |
| 4,030,095 | 6/1977 | Dalman | 340/505 |
| 4,118,694 | 10/1978 | Right | 340/506 |
| 4,249,166 | 2/1981 | Schultz | 340/506 |
| 4,253,091 | 2/1981 | Frydman | 340/506 |
| 4,529,971 | 7/1985 | James | 340/508 |

*Primary Examiner*—Donnie L. Crosland
*Attorney, Agent, or Firm*—Donald J. Lenkszus

[57] ABSTRACT

An adapter module for converting a Class B alarm system to Class A operation. The module includes a first pair of terminals connected to corresponding terminals of a Class B control panel, and second and third pairs of terminals to which Class A alarm loops are connected, one terminal of each of the second and third pairs of terminals being directly electrically connected to a separate terminal of the first pair of terminals.

8 Claims, 1 Drawing Sheet

APPARATUS FOR IMPROVING THE RELIABILITY OF AN ALARM CIRCUIT

The present invention relates to alarm circuits and more particularly to a system for converting a class B alarm circuit to more reliable class A operation.

BACKGROUND OF THE INVENTION

Various types of systems are called upon to signal an alarm condition when a specified event occurs. Examples of such systems are fire alarms and burglar alarms. Because of the reliance placed on such systems, steps must be taken to insure the reliability of the alarm circuit. One step which is commonly taken is the use of separate supervisory and alarm modes. In supervisory mode the alarm circuit is monitored to insure that it is in working order, i.e. has no broken wires or other open circuits. When an alarm condition occurs, the circuit shifts from supervisory to alarm mode, causing the alarm to be signaled.

Such alarm circuits may be divided into two general groups. These are known as "class A" circuits and "class B" circuits. A class A circuit has certain fail-safe features not present in a class B circuit. If an open circuit condition occurs in a class B circuit the alarm will not function until the open circuit is repaired. In a class A circuit, however, an open circuit, while detectable by the supervisory mode of the system, will not prevent the alarm from sounding should an alarm condition occur. Class A circuits, therefore, have significant advantages over class B circuits in providing increased safety, by insuring that alarms will be sounded if an alarm condition arises before an open circuit can be repaired.

Alarm systems commonly are designed with a central panel which acts as a controller and various remote sensors and alarms. The design of the central panel will determine whether a class A or a class B alarm circuit may be connected thereto. In some situations, however, it may be desirable to upgrade a system which has been previously installed with class B alarm circuits to class A alarm circuits. Therefore, a system for converting class B alarm circuits to class A is desirable.

SUMMARY OF THE INVENTION

In the present invention an adapter circuit is provided which allows a central control panel designed to accept a class B alarm circuit to be upgraded to support a class A alarm circuit.

DETAILED DESCRIPTION OF A PREFERRED EMBODIMENT

Figure 1:
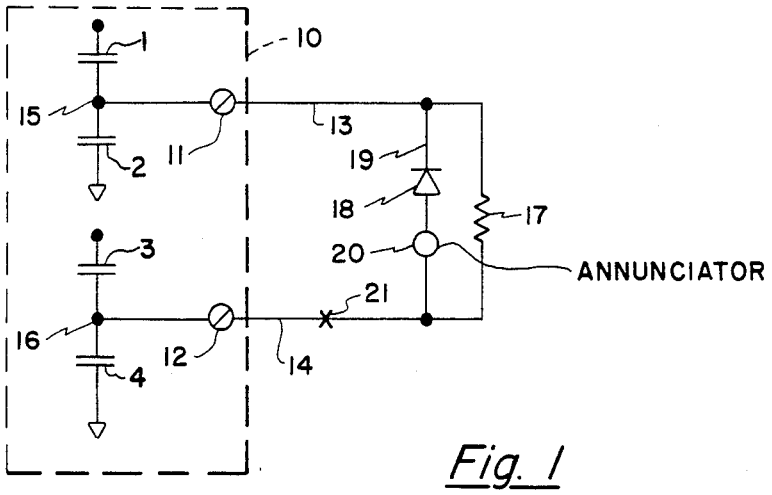
FIG. 1 is a schematic diagram of a class B alarm circuit.

FIG. 1 illustrates a typical class B alarm circuit. The portion of the alarm circuit enclosed by box 10 would typically be provided on a central control panel, while the remainder of the circuit would be external to such a panel.

The portion of the circuit on panel 10 includes terminals 11 and 12 which connect to the external alarm circuitry via conductors 13 and 14 thereof, respectively.

The output 15 and 16 have capacity 1, 2 and 3, 4 connected thereto. In supervisory mode circuit nodes 15 and 16 are electrically biased such that an electric current flows from node 15 to node 16. In so doing, it will flow through load resistor 17, but diode 18 will prevent current flow through circuit branch 19 thus preventing the activation of annunciator 20. In supervisory mode, if there is an open circuit condition, such as that which is indicated at point 21 on the circuit, the current will be unable to flow and the presence of an open circuit will be indicated on the control panel.

When an alarm condition occurs, nodes 15 and 16 will be electrically biased so that an electrical current will flow from node 16 to node 15. When this occurs, diode 18 will be forward biased allowing current to flow through circuit branch 19 thus activating annunciator 20. Annunciator 20 may be a bell, a horn, a light, or any other signaling device which will indicate the existence of an alarm condition. As may be seen, if an open circuit condition occurs, such as at point 21, no complete circuit will exist, preventing the signaling of an alarm condition.

Figure 2:
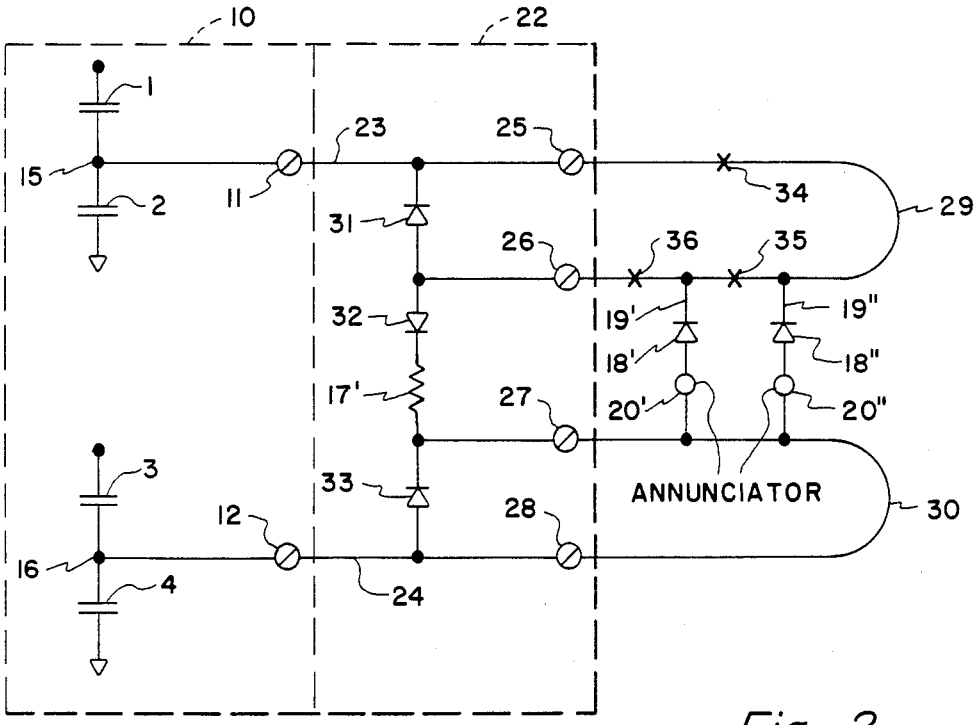
FIG. 2 is a schematic diagram of a class B alarm circuit which has been converted to a class A alarm circuit using the adapter of the invention.

Turning now to FIG. 2, the portions within box 10, i.e. the portions on the central control panel, match those of FIG. 1. The portion within box 22 is a module which may be connected to terminals 11 and 12 in order to convert the circuit to class A operation. In a preferred embodiment the circuitry in box 22 would be provided on a printed circuit board which could be attached to the central control panel. The circuitry in box 22 includes terminals 23 and 24 which connect to terminals 11 and 12, respectively. The circuitry in module 22 further includes terminals 25, 26, 27 and 28 for connection to alarm loops. The circuitry also includes diodes 31, 32. and 33 and resistor 17'. Diodes 31, 32 and 33 are not required for proper operation of the circuit, but are preferred. Particularly, the reasons for preferring the presence of diodes 32 are described in my copending, Ser. No. 880,625, and filed July 1, 1986. In operation loop 29 is electrically connected to terminals 25 and 26 while loop 30 is electrically connected to terminals 27 and 28. Alarm branches 19' and 19'' run between the two loops include diode diode 18' and annunciator 20' and 18'' and annunciator 20'', respectively.

As in the previous example, when the circuit of FIG. 2 is in supervisory mode, nodes 15 and 16 are electrically biased so that an electric current flows from node 15 to node 16. This current may be used to detect open circuits at locations in the alarm loops. For example, open circuits at location 34, 35 or 36 would be detected. When an alarm condition occurs, the biasing on nodes 15 and 16 is changed so that current will flow from node 16 to node 15. As before, this will cause the annunciators to be activated. Unlike the circuit of circuit 1, however, an open circuit which has not been repaired at locations such as 34, 35, 36 or at similar locations on loop 30 will not prevent activation of the annunciators, therefore, producing a fail-safe system.

The embodiments of an invention in which an exclusive property or right is claimed are defined as follows:

1. A module for a central control panel having first and second terminal means for providing output signals to a class B alarm circuit to allow said central control panel to be connected to a class A alarm circuit, said module comprising:

support means for holding electrical components;

first and second terminal means for electrically connecting to said central control panel, said module first and second terminal means being physically attached to said support means;

third, fourth, fifth and sixth terminal means for electrically connecting a class A alarm circuit, said third terminal means being directly electrically connected to said module first terminal means, and said sixth terminal means being directly electrically connected to said module second terminal means, said third, fourth, fifth and sixth terminal means being physically attached to said support means;

first connecting means for electrically connecting said fourth terminal means to said fifth terminal means, said first connecting means being physically attached to said support means;

said third and fourth terminal means being connectable to a first loop of a pair of loops of a class A alarm circuit; and said fifth and sixth terminal means being connectable to a second loop of said pair of loops.

2. The module of claim 1 wherein said first connecting means includes electrical resistance means.

3. The module of claim 2 wherein said first connecting means includes diode means.

4. The module of claim 3 wherein said support means is a printed circuit board.

5. The module of claim 1 comprising:

second connecting means for electrically connecting said third terminal means to said fourth terminal means; and third connecting means for electrically connecting said fifth terminal means to said sixth terminal means;

said second and third connecting means being physically attached to said support means.

6. The module of claim 5 wherein said first and third connecting means each contain diode means.

7. The module of claim 6 wherein said first connecting means includes diode means.

8. The module of claim 7 wherein said support means is a printed circuit board.

* * * * *